US006123326A

United States Patent [19]

Kleinbongartz

[11] Patent Number: 6,123,326

[45] Date of Patent: Sep. 26, 2000

[54] CLAMPING TOOL

[75] Inventor: Wolfgang Kleinbongartz, Remscheid, Germany

[73] Assignee: Kleinbongartz & Kaiser, Remscheid, Germany

[21] Appl. No.: 09/115,708

[22] Filed: Jul. 15, 1998

[30] Foreign Application Priority Data

Jul. 29, 1997 [DE] Germany ..... 297 13 482 U

[51] Int. Cl.[7] ..... B25B 5/02

[52] U.S. Cl. ..... 269/215; 269/3; 269/143; 269/249

[58] Field of Search ..... 269/215, 249, 269/6, 143, 208, 3, 254 CS

[56] References Cited

U.S. PATENT DOCUMENTS

| | | | |
|---|---|---|---|
| 140,747 | 7/1873 | Walker | 269/215 |
| 1,741,923 | 12/1929 | Dohnal | 269/249 |
| 1,744,197 | 1/1930 | Anderson | 269/208 |
| 1,930,177 | 10/1933 | Miller et al. | 269/215 |
| 2,671,482 | 3/1954 | Gordon | 269/249 |
| 2,675,839 | 4/1954 | Beasley | 269/208 |
| 3,623,718 | 11/1971 | Thomeczek, Sr. | 269/215 |
| 4,176,830 | 12/1979 | Isley | 269/249 |
| 5,427,364 | 6/1995 | Zborschill | 269/249 |
| 5,850,680 | 12/1998 | Verrier et al. | 269/249 |

FOREIGN PATENT DOCUMENTS 3218486 11/1983 Germany .

*Primary Examiner*—David A. Scherbel
*Assistant Examiner*—Lee Wilson
*Attorney, Agent, or Firm*—Martin A. Farber

[57] ABSTRACT

A clamping tool, in particular a screw clamp (1) having a fixed bracket (3), which provides a clamping surface (4) and is fixedly connected to a slide rail (2) on which a sliding bracket (5) is seated such that it can be displaced and secured, and having a counter clamping surface (8) which, by a clamping element (7), can be braced against a workpiece which can be clamped between the clamping surface (4) and the counter clamping surface (8), the eyelet (6) of the sliding bracket (5) being secured against slipping with respect to the profiled slide rail (2). A latching body (13) which is associated with the sliding bracket (5), projects into the eyelet (6), and is capable of yielding resiliently for cooperation with a latching profiling (10) of the slide rail (2).

7 Claims, 2 Drawing Sheets

CLAMPING TOOL

FIELD AND BACKGROUND OF THE INVENTION

The invention relates to a clamping tool, in particular a screw clamp having a fixed bracket, which provides a clamping surface and is fixedly connected to a slide rail on which a sliding bracket is seated such that it can be displaced and secured, and having a counter clamping surface which, by means of a clamping element, can be braced against a workpiece which can be clamped in between clamping surface and counter clamping surface, the eyelet of the sliding bracket being secured against slipping with respect to a profiled slide rail.

Different embodiments of such clamping tools, in particular screw clamps, for example in the form of so-called all-steel screw clamps or screw clamps with a steel section slide rail and malleable-cast-iron brackets, are known. Among these embodiments, there are also known those which have a device for securing the sliding bracket against slipping with respect to the slide rail. For this purpose, the sliding bracket tilts when a workpiece is clamped with respect to the fixed bracket, as a result of which the sliding bracket is fixed in place. In this respect, it is also known to profile the slide rail. A further embodiment of the antislip device is known from DE-A1 32 18 486. In order to secure the sliding bracket against slipping, this document provides a threaded pin which is positioned such that it projects into the eyelet of the sliding bracket to a slight extent. If the sliding bracket tilts with respect to the slide rail during clamping of a workpiece, then the threaded profile of the threaded pin is pressed against the outer narrow side of the slide rail in order to prevent the sliding bracket from slipping under the action of the clamping forces.

SUMMARY OF THE INVENTION

Having regard to the above described state of the art, a object problem of the invention is to provide a clamping tool of the type in question with an antislip device which is independent of the position of the clamping tool.

ACCORDING TO THE INVENTION

In this, an antislip device which is independent of the position of the clamping tool is provided by a latching body which is associated with the sliding bracket, projects into the eyelet, and is capable of yielding resiliently for cooperation with a latching profiling of the slide rail. The latching body cooperates with the latching profiling of the slide rail such that the antislip device reliably takes effect even before a workpiece has been clamped in. The known solutions of the antislip devices also, in part, take effect in a non-braced state, this resulting in a prestressed position. However, in this position of the clamping tool, these antislip devices are dependent on the force of gravity. Thus, when the clamping tool is applied with a preset position of the sliding bracket, it is possible for the latter to lose its secured position and slip off again, for example, as a result of vibrations. In the presence of vibrations or in the event of the clamping tool being applied without due care, the tilted position of the sliding bracket with respect to the slide rail is disengaged, and this results in slipping. The present invention counteracts this disadvantage, which concerns handling in particular. The arrangement of a latching body, which can yield resiliently, in the eyelet of the sliding bracket provides an antislip device which is independent of the force of gravity. For this purpose, the latching body is arranged such that it is always forced resiliently in the direction of the latching profiling of the slide rail. This antislip device can only be disengaged if this is the specific intention. In a preferred configuration, it is provided that the latching body is a spring-loaded ball. The latching body, which is provided in the form of a ball, is always forced in the direction of the latching profiling by the spring, and this ensures that the sliding bracket is fixed reliably on the slide rail in each latching position. In a development of the subject matter of the invention, it is provided that the latching profiling is constituted by latching hollows which are spaced apart from one another in the direction in which the rail extends. Said latching hollows are preferably matched in terms of cross-section to the latching body, or to the ball which forms the latching body. It is also preferred to have a multiplicity of latching hollows, the spacing between two latching hollows preferably being in the millimeter range, for example 3 to 5 mm. This allows fine adjustment for the preliminary positioning of the sliding bracket. It is also preferred for the latching hollows to be located on the broad side of the rail. However, it is also conceivable for the latching hollows to be provided on the narrow side of the rail. It is also possible for the latching hollows to be formed on the two broad sides of the rail and on the two narrow sides of the rail, for cooperation with two latching bodies projecting into the eyelet of the sliding bracket. The construction is advantageously selected such that the latching body is accommodated approximately in the centre of the broad-side wall of the eyelet. As a result of this, the latching body, for example in the form of a spring-loaded ball, acts centrally on the slide rail, which contains the latching profiling. Finally, it is provided that the latching body acts on the slide rail functionally independently of the securing of the sliding bracket.

BRIEF DESCRIPTION OF THE DRAWINGS

With the above and other objects and other advantages in view, the present invention will become more clearly understood in connection with the detailed description of preferred embodiments, when considered with the accompanying drawings of which.

DETAIL DESCRIPTION OF THE PREFERRED EMBODIMENTS

Figure 1:
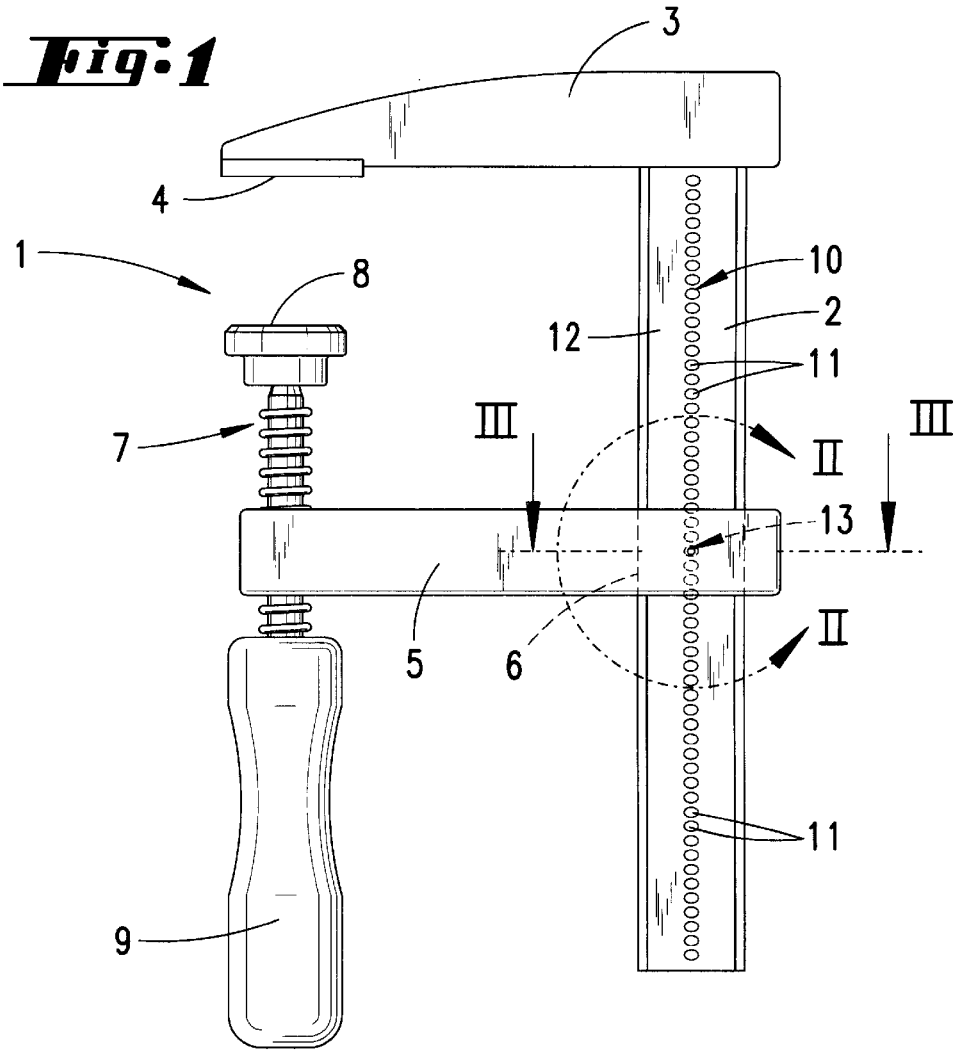
FIG. 1 shows a side view of a first embodiment of a clamping tool according to the invention in the form of a screw clamp, comprising a steel slide rail having a fixed bracket which is fixedly attached to the rail, and having a sliding bracket which can be displaced on the slide rail.
Figure 2:
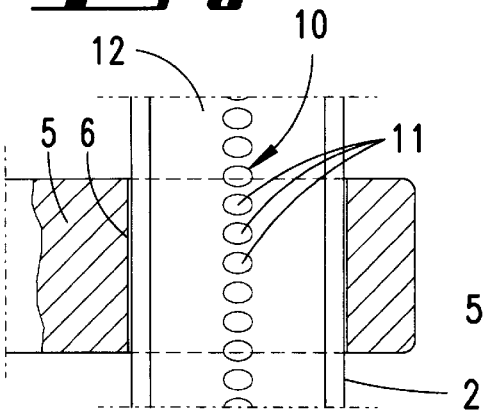
FIG. 2 shows an enlarged illustration, partially in section, of the region II—II in FIG. 1.
Figure 3:
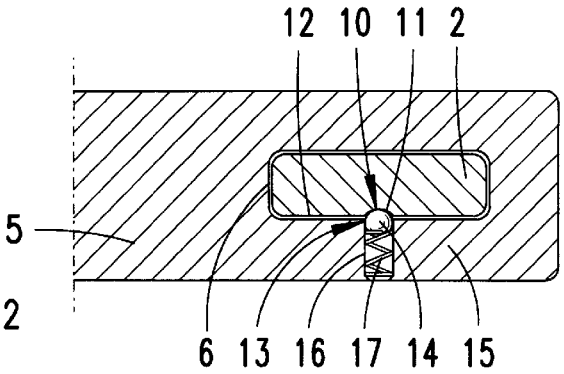
FIG. 3 shows the section along line III—III in FIG. 1.

Illustrated and described, first of all with reference to FIG. 1, is a screw clamp 1 comprising a steel slide rail 2 having a fixed bracket 3 which is fixedly connected to the rail and is produced, for example, from malleable cast iron. At one end, the fixed bracket 3 is fixedly connected to the slide rail 2 and, at the other end, the bracket provides a clamping surface 4 on the underside.

In addition, a sliding bracket 5 is arranged displaceably on the slide rail 2, the slide rail 2 passing through the sliding bracket 5 in the region of the eyelet 6 of the sliding bracket. In the region of its freely extending end, the sliding bracket 5 carries a clamping element 7 which is provided with a thread, for example a trapezoidal thread. At its end which is directed towards the clamping surface 4 of the fixed bracket 3, the clamping element 7 is provided with a counter clamping surface 8 and, at the other end, it is provided with a rotary handle 9 for the axial displacement of the clamping element 7.

For the purpose of clamping a workpiece in, the counter clamping surface 8 can be braced in the direction of the clamping surface 4 by means of the clamping element 7.

The screw clamp 1 according to the invention is provided with a device which secures the sliding bracket 5 against slipping with respect to the slide rail 2. For this purpose, the slide rail 2 is provided with a latching profiling 10 which, in the exemplary embodiment shown, is provided in the form of latching hollows 11 which are spaced apart uniformly from one another in the direction in which the rail extends. The latching hollows are arranged centrally on the broad side 12 of the rail and cooperate with a latching body 13 of the sliding bracket 5.

In the exemplary embodiment shown, this latching body 13 is a spring-loaded ball 14, which is accommodated approximately in the centre of a broad-side wall 15 of the eyelet 6 in a through-passage bore 16 of the sliding bracket 5. In order to secure this ball 14 against dropping out, that end region of the bore 16 which is oriented towards the eyelet 6 is profiled such that a section of the ball 14 can pass out of the bore 16 into the region of the eyelet 6.

In order for the latching body 13, or the ball 14, to be arranged such that it can yield resiliently, there is provided in the bore 16 a compression spring 17 which, at one end, is supported against the ball 14 and, at the other end, is supported against a, for example, inwardly-shaped shoulder of the bore 16. Accordingly, the ball 14, which forms the latching body 13, can yield resiliently inwards, i.e. in the direction of the bore 16, and is simultaneously secured, by virtue of the profiling, against dropping out.

The latching hollows 11, which form the latching profiling 10, are spaced apart uniformly from one another in the direction in which the rail extends, the distance between two latching hollows 11 being in the millimeter range, for example 3 to 5 mm. The cross-section of each latching hollow 11 is preferably matched to that of the ball 14.

The antislip device, which substantially comprises the latching body 13 and latching profiling 10, ensures that the sliding bracket 5 is fixed in place on the slide rail 2 irrespective of the position of the clamping tool. This preset position of the sliding bracket 5 can only be changed if this is the specific intention, in which case the sliding bracket 5 is displaced along the slide rail 2 by hand. In this circumstance, the latching body 13, or the ball 14, can yield and, always with the assistance of the spring, finds the next latching stage.

This antislip device cannot, as is known from the prior art, be disengaged as a result of vibrations or being handled with undue care. Thus, in the preset position of the sliding bracket 5, the screw clamp 1 according to the invention can be reliably advanced up to the workpiece which is to be clamped in, without there being any change in the preset clamping width between sliding bracket 5 and fixed bracket 3.

Figure 4:
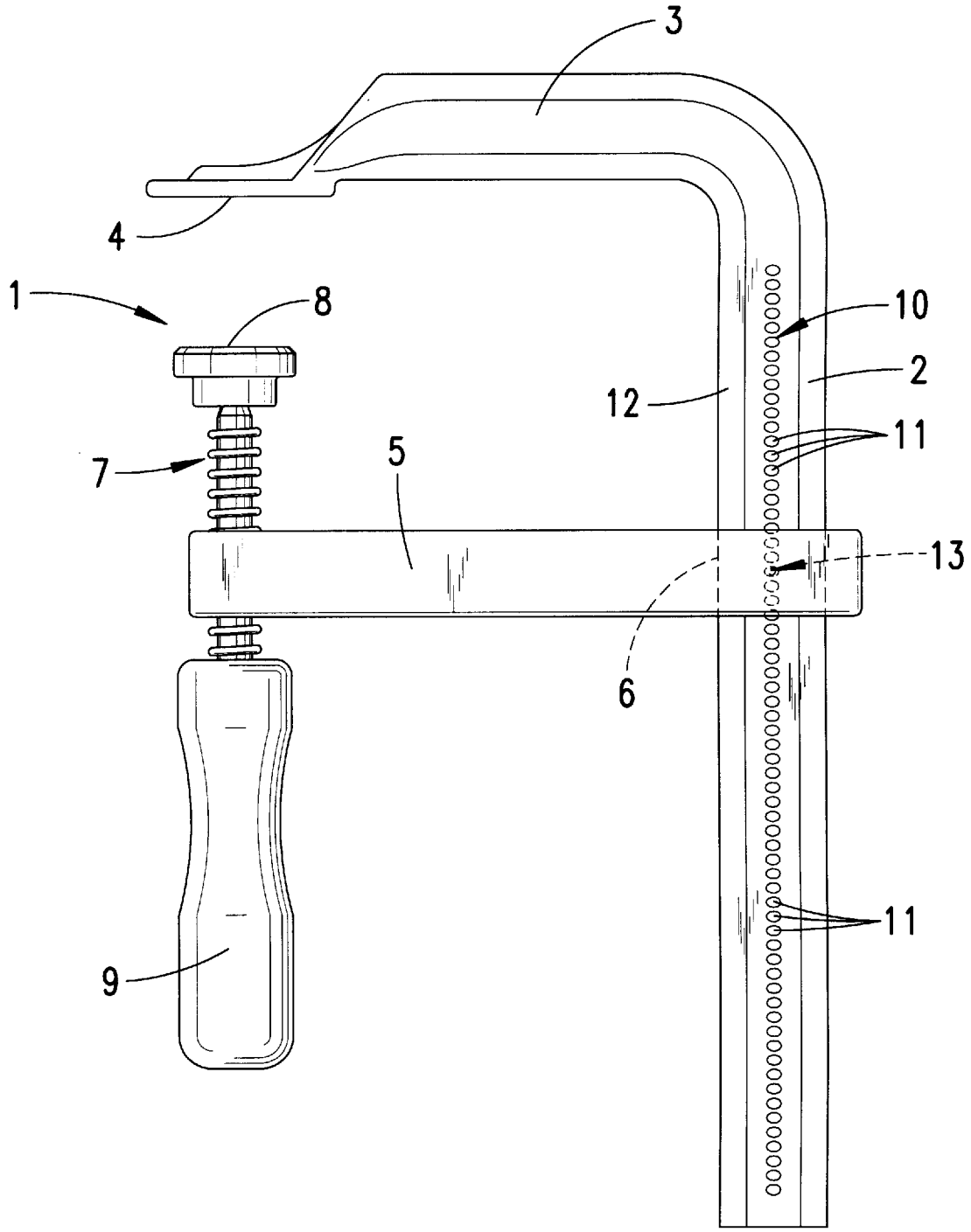
FIG. 4 shows an illustration corresponding to FIG. 1, but relating to a second embodiment, the clamping tool being formed as an all-steel screw clamp.

In FIG. 4, the antislip device according to the invention is formed on an all-steel screw clamp 1, slide rail 2 and fixed bracket 3 being produced integrally, for example from a cold-drawn steel. Here too, the slide rail 2 has latching hollows 11 which form a latching profiling 10 and interact with a latching body 13, provided in the form of a ball 14, of the sliding bracket 5 for the purpose of forming the antislip device.

What is claimed is:

1. Clamping tool, in particular screw clamp (1) having a fixed bracket (3), which provides a clamping surface (4) and is fixedly connected to a slide rail (2) on which a sliding bracket (5) is seated such that it can be displaced and secured, and having a counter clamping surface (8) which, by means of a clamping element (7), can be braced against a workpiece which can be clamped in between the clamping surface (4) and the counter clamping surface (8);

wherein the sliding bracket (5) comprises an eyelet (6) operative for clamping the sliding bracket along the slide rail (2) by engagement with the slide rail upon a tilting of the sliding bracket relative to the slide rail under load;

the slide rail has a latching profiling (10), and the tool further comprises a latching body (13) which in associated with the sliding bracket (5), projects into the eyelet (6), and is capable of yielding resiliently during a sliding of the sliding bracket for cooperation with the latching profiling (10), having an anti-slip effect of the slide rail (2); and the latching body (13) acts on the slide rail (2) functionally independently of the securing of the sliding bracket (5) by the tilting.

2. Clamping tool according to claim 1, wherein the latching body (13) is a spring-loaded ball (14).

3. Clamping tool according to claim 1, wherein the latching profiling (10) is constituted by latching hollows (11) which are spaced apart from one another in the direction in which the rail extends.

4. Clamping tool according to claim 3, wherein the latching hollows (11) are located on a broad side (12) of the slide rail.

5. Clamping tool according to claim 1, wherein the latching body (13) is accommodated approximately in the center of a broad-side wall (15) of the eyelet (6).

6. Clamping tool, in particular screw clamp (1) having a fixed bracket (3), which provides a clamping surface (4) and is fixedly connected to a slide rail (2) on which a sliding bracket (5) is seated such that it can be displaced and secured, and having a counter clamping surface (8) which, by means of a clamping element (7), can be braced against a workpiece which can be clamped in between the clamping surface (4) and the counter clamping surface (8);

wherein the sliding bracket (5) comprises an eyelet (6) operative for for clamping the sliding bracket along the slide rail (2) by engagement with the slide rail upon a tilting of the sliding bracket relative to the slide rail under load;

the slide rail has a latching profiling (10), and the tool further comprises a latching body (13) which is associated with the sliding bracket (5), projects into the eyelet (6), and is capable of yielding resiliently during a sliding of the sliding bracket for cooperation with the latching profiling (10), having an anti-slip effect of the slide rail (2);

the latching profiling (10) is constituted by latching hollows (11) which are spaced apart from one another in the direction in which the rail extends; and a cross-section of each of said latching hollows is matched to a ball, a region of said latching body has a ball shape at a point of contact with an individual one of said latching hollows, the configuration of each of respective ones of said latching hollows cooperating with the shape of said latching body to enable a sliding of said sliding bracket by hand in any direction.

7. Clamping tool according to claim 1, wherein the latching body is deflectable automatically and elastically out of the latching profiling in the event of displacement of the sliding bracket on the slide rail in either directions.

* * * * *